United States Patent [19]

Allen

[11] Patent Number: 4,681,515

[45] Date of Patent: Jul. 21, 1987

[54] WALKING BEAM PUMP HAVING ADJUSTABLE CRANK PIN

[76] Inventor: James C. Allen, 102 W. 8th St., Safford, Ariz. 85548

[21] Appl. No.: 883,578

[22] Filed: Jul. 9, 1986

Related U.S. Application Data

[63] Continuation-in-part of Ser. No. 704,948, Feb. 25, 1985, abandoned.

[51] Int. Cl.[4] ..... F04B 49/00; F04B 35/04; F16H 35/08

[52] U.S. Cl. ..... 417/218; 417/411; 417/415; 417/45; 74/41; 74/600; 74/601; 74/602; 74/424.8 A; 74/837; 92/13.1; 92/13.7

[58] Field of Search ..... 417/212, 218, 221, 411, 417/415, 14, 45; 92/13.1, 13.4, 13.7; 74/41, 600–602, 837, 424.8 A

[56] References Cited

U.S. PATENT DOCUMENTS

| | | | |
|---|---|---|---|
| 17,862 | 7/1857 | Allen | 74/601 |
| 713,817 | 11/1902 | Tinney | 74/601 X |
| 736,530 | 8/1903 | Lowrie et al. | 74/601 |
| 1,976,241 | 10/1934 | Matlerne | 74/600 |
| 2,017,169 | 10/1935 | Slader | 74/41 X |
| 2,319,485 | 5/1943 | Alabrune | 74/600 |
| 2,915,919 | 12/1959 | Mitchell et al. | 74/41 X |
| 3,359,825 | 12/1967 | Wiig | 74/600 |
| 4,065,032 | 12/1977 | Lydiksen | 74/837 X |
| 4,210,136 | 7/1980 | Apple | 92/13.1 X |
| 4,586,879 | 5/1986 | Slater | 417/411 |

FOREIGN PATENT DOCUMENTS

| | | | |
|---|---|---|---|
| 10173 | 1/1980 | Japan | 74/837 |
| 945664 | 7/1982 | U.S.S.R. | 74/600 |

OTHER PUBLICATIONS

Blue Sky Water Supply Company brochure, "Solar Water Systems", 4 pages.

Dempster Company brochure, "Dempster Hi-Efficiency Solar Pump Jack Powered by Tri Solar".

*Primary Examiner*—Carlton R. Croyle

*Assistant Examiner*—Paul F. Neils

*Attorney, Agent, or Firm*—H. Gordon Shields

[57] ABSTRACT

Variable stroke pump apparatus includes a photovoltaic array for providing electrical current to motors, one of which provides for the pumping action of a walking beam, one of which provides for movement of a control unit which varies the length of stroke of the pumping apparatus from a minimum of zero to a maximum, and one of which operates a counterweight for moving the counterweight in response to the pumping load. The apparatus includes mechanical elements which adjust the length of the stroke of the pumping arm, and a control system which controls the length of the pumping stroke in response to the output of the photovoltaic array.

27 Claims, 16 Drawing Figures

FIG. 1
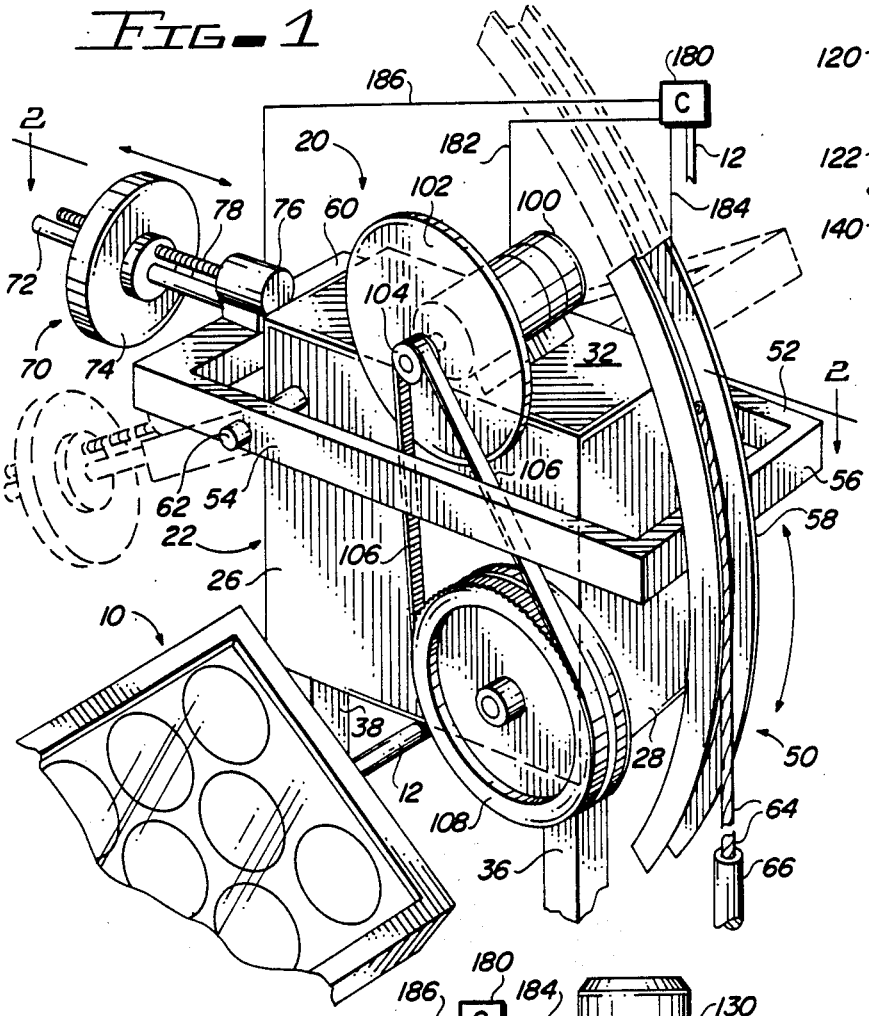
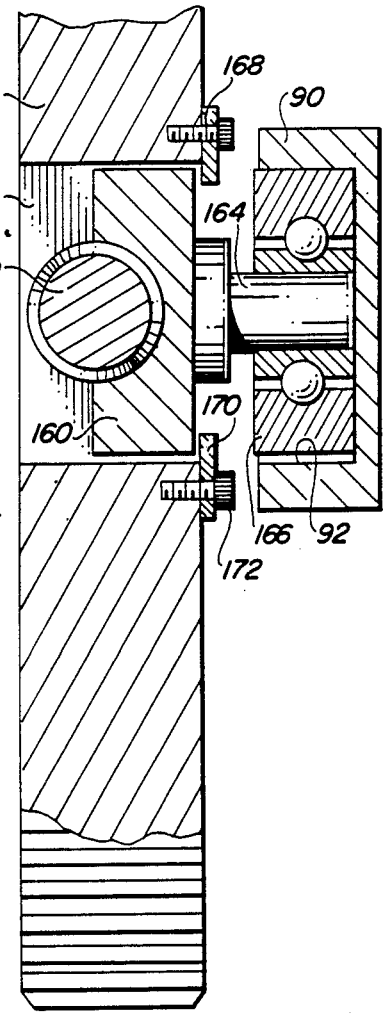
FIG. 4
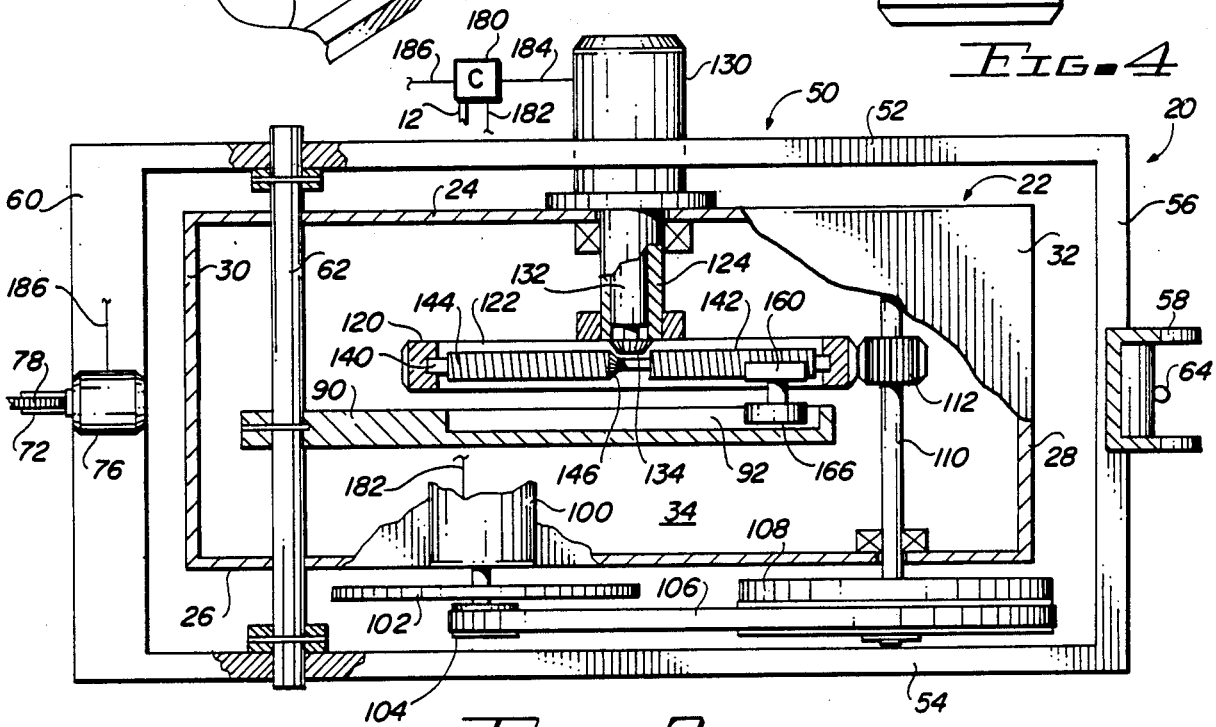
FIG. 2

FIG. 9
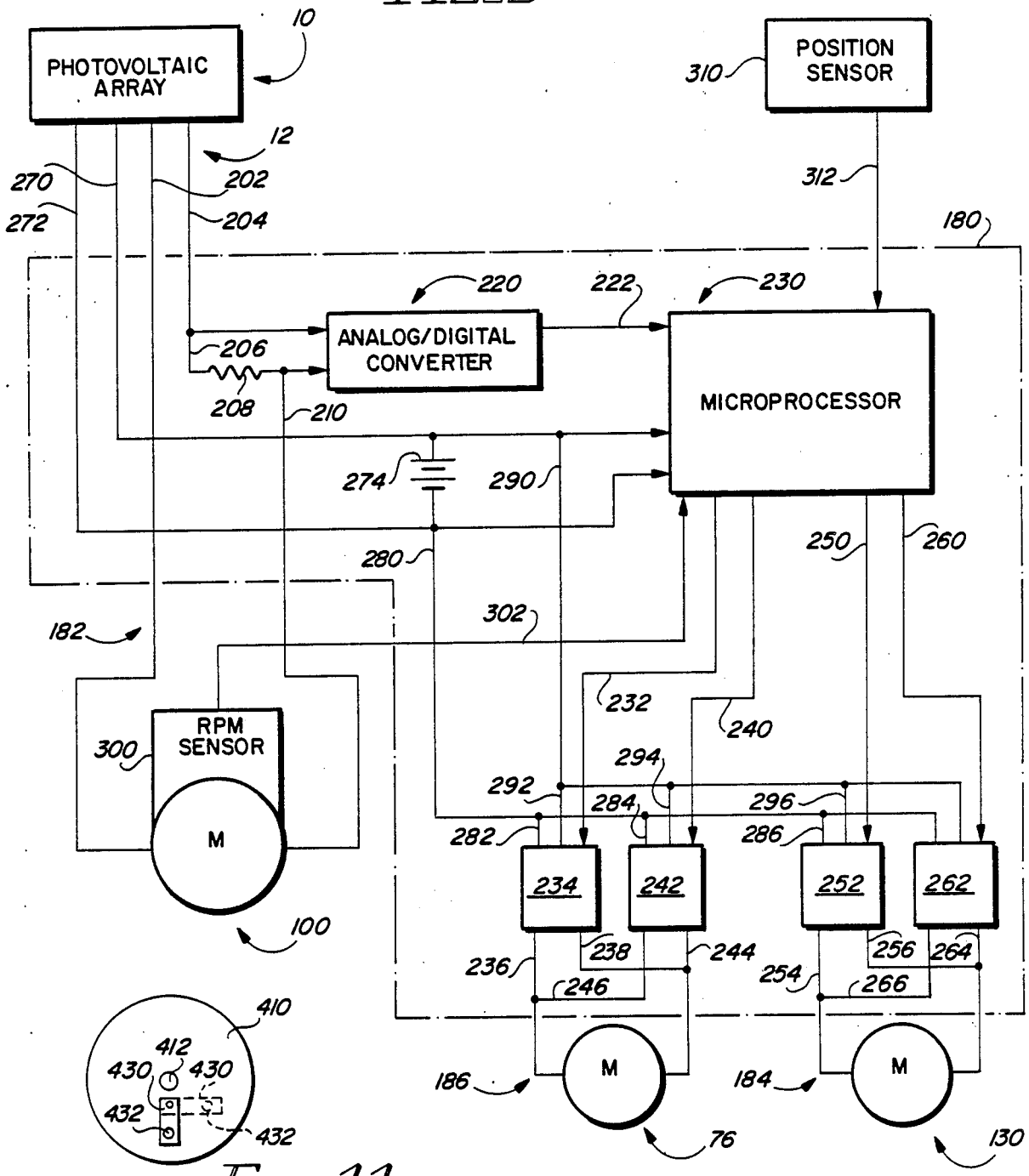
FIG. 11
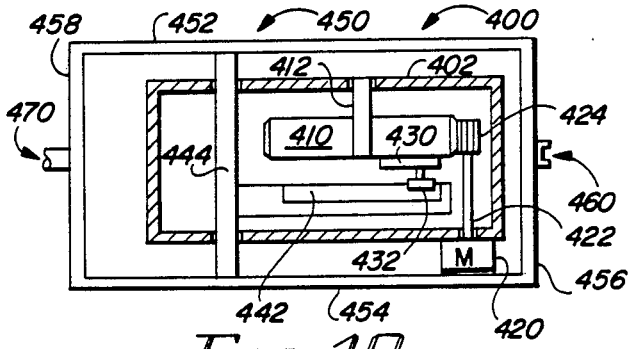
FIG. 10
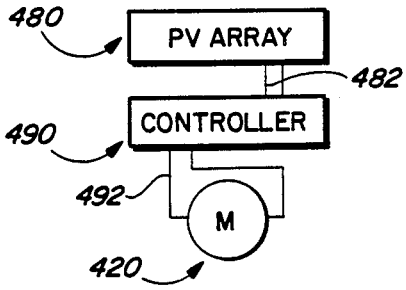
FIG. 12

WALKING BEAM PUMP HAVING ADJUSTABLE CRANK PIN

CROSS-REFERENCE TO RELATED APPLICATION

This application is a continuation-in-part of copending application Ser. No. 704,948, filed Feb. 25, 1985, now abandoned.

BACKGROUND OF THE INVENTION

1. Field of the Invention

This invention relates to pumps, and, more particularly, to variable output pumps.

2. Description of the Prior Art

U.S. Pat. No. 713,817 discloses a windmill with control apparatus for varying the pumping of the windmill in response to changes in the velocity of the wind. A crank pin moves in response to the available wind energy to increase or decrease the length of the pumping stroke.

U.S. Pat. No. 733,799 discloses windmill apparatus in which the length of a pumping stroke is controlled in response to the discharge from the pump. The discharge from the pump is in response to need for water, as opposed to available wind energy.

U.S. Pat. No. 1,976,241 discloses a slot arrangement for a walking beam pump in which the crank pin radius is changed for changing the stroke of the pump. The crank pin radius is changed by physically altering the length of the crank arm through a pin arrangement.

U.S. Pat. No. 2,576,765 discloses another type of apparatus for changing the crank arm distance to vary the stroke of a pump through the use of a disc which includes a plurality of pin locations. The disc has an eccentric center of rotation, and thus varying the connection to adjacent elements by rotating the disc causes the length of the crank arm to vary.

U.S. Pat. No. 3,359,825 discloses an electric system for shifting a crank pin inwardly and outwardly through actuation of a gearing system.

It will be noted that none of the above-discussed patents utilizes solar energy or changes a pump stroke in response to changes of solar energy. The closest concept to varying the output of a pump in response to changes in output of solar energy is in the '817 patent, which changes the length of a pumping stroke in response to changes in wind velocity. As far as it is known, there is no apparatus which varies the stroke of a pump in response to solar energy changes, as does the apparatus of the present invention.

The apparatus of the present invention is designed to utilize solAr energy to pump water, as for livestock in remote areas, etc., where the apparatus will be substantially self-regulating and will be left unattended for substantial periods of time. Obviously, in such remote areas, the availability of electrical power is virtually nil. The use of gasoline powered or diesel powered engines is feasible, but such engines usually require an attendant for starting and stopping the engines, or at least to start them. Under some circumstances, a timer may be used to turn them off. With the apparatus of the present invention, a pump is actuated in response to solar energy, and the output of the pump is directly related to, or is in response to, the solar energy available.

While there are pumps on the market today which are operated by photovoltaic energy, most of the pumps are designed for shallowwell pumping. In most cases, the pumps are classified as centrifugal pumps, as opposed to positive displacement pumps.

For high-head, low flow pumping situations, a reciprocating volumetric piston pump, or pump jack, is preferred. This type of pump is, and has been, the standard of the oil industry since deep well oil pumping began, and it is also the standard for high head, low flow water pumping. However, such pump jacks have not been used more widely with photovoltaic power because of the typically gross mismatch between the electrical load requirements of the pumps and the output of photovoltaic (pv) arrays.

The apparatus of the present invention overcomes the problems of photovoltaic powered reciprocating piston pumps by providing a pump having substantially constant speed and continuously variable stroke responsive to the output of the pv array and a pump having variable speed and fixed, but selectively adjustable, stroke, with the speed responsive to the output of the pv array.

SUMMARY OF THE INVENTION

The invention described and claimed herein comprises a pump apparatus utilizing photovoltaic energy for both reciprocating a walking beam and for controlling either the length of the stroke of the walking beam by moving the pivot point of an output link which is in turn connected to the walking beam or the speed of the pump motor. The control system in one embodiment includes a rotating bull gear and a movable crank pin on the bull gear which causes reciprocating movement in the link secured to the walking beam. The crank pin moves toward and away from the center of rotation of the bull gear to vary the length of stroke of the link, and in turn the length of the stroke of the walking beam is varied. In the other embodiment, the controller changes the speed of the pump motor, and the length of the pumping stroke remains fixed until manually changed. In both embodiments, the downstroke is faster than the upstroke.

Among the objects of the present invention are the following:

To provide new and useful pump apparatus;

To provide new and useful solar powered pump apparatus;

To provide new and useful pump apparatus having a variable stroke;

To provide new and useful control apparatus for varying the length of stroke of a pump;

To provide new and useful apparatus for varying the stroke of a pump in response to changes in solar energy;

To provide new and useful pump apparatus in which the length of the stroke remains substantially constant while the speed varies; and To provide new and useful pump apparatus in which the speed of the pumping upstroke and downstroke varies.

BRIEF DESCRIPTION OF THE DRAWING

FIG. 1 is a perspective view of the apparatus of the present invention.

FIG. 2 is a view in partial section taken generally along line 2—2 of FIG. 1.

FIG. 4 is a view in partial section taken generally along line 4—4 of FIG. 3.

FIG. 9 is a schematic circuit diagram for the apparatus of FIGS. 1–8C.

FIG. 10 is a schematic representation of a portion of an alternate embodiment of the apparatus of the present invention.

FIG. 11 is a schematic representation of the apparatus of FIG. 10 illustrating cooperative elements.

FIG. 12 is a schematic circuit diagram of the motor for the apparatus of FIGS. 10 and 11.

DESCRIPTION OF THE PREFERRED EMBODIMENT

Figure 3:
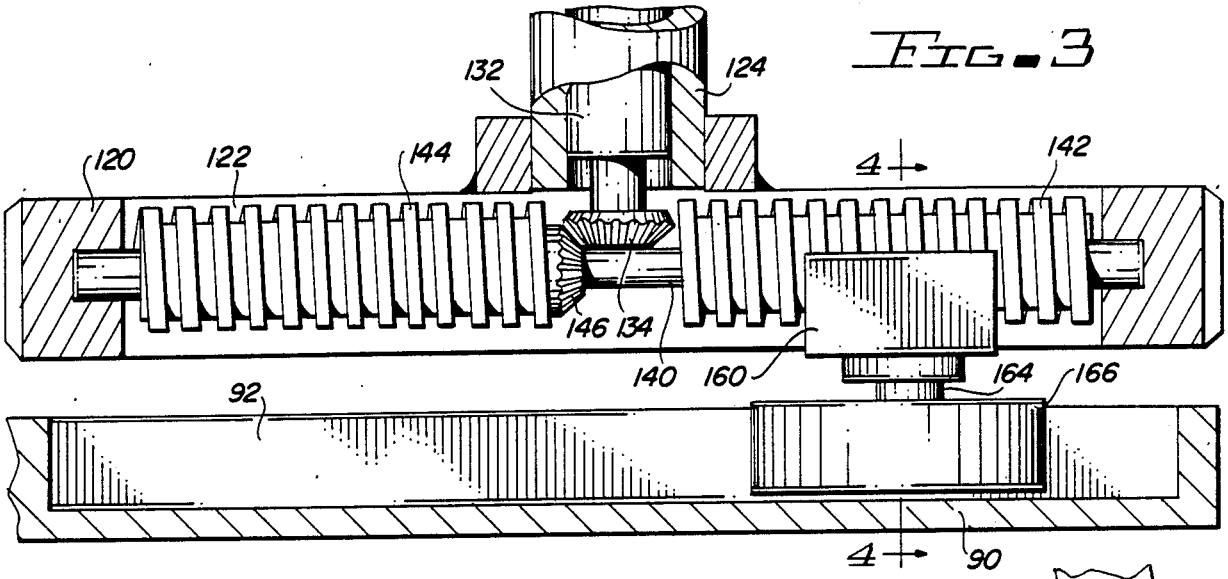
FIG. 3 is a view in partial section of a portion of the apparatus of the present invention.

FIG. 1 is a perspective view of a photovoltaic array 10 coupled to pump apparatus 20 embodying the present invention. The photovoltaic apparatus or array 10 comprises an array of solar cells which change solar energy into electrical energy. The electrical energy, which varies in response to, or in accordance with, the amount of sunlight which is received, is coupled to the pump apparatus 20 by appropriate electrical connectors disposed within an electrical conduit 12. While the photovoltaic system 10 is merely shown schematically, such arrays are well known and understood, and accordingly details are not given herein concerning the operation of such apparatus.

The pump apparatus 20 includes a cabinet 22 which is generally of a rectangular configuration and which includes six panels. The panels include a pair of rectangular and parallel side panels 24 and 26, a front panel 28, a rear panel 30, a top panel 32, and a bottom panel 34. The cabinet 22 is supported on four legs. Of the four legs, two legs 36 and 38 are shown in FIG. 1.

A walking beam assembly 50, which is generally of a rectangular configuration, is appropriately disposed outside the cabinet 22 and moves in response to, ultimately, the output of the photovoltaic array 10. The walking beam assembly includes a side beam 52, a side beam 54, a front beam 56, and a rear beam 60. The walking beam assembly 50 is appropriately pinned to rigidly secure it to a shaft 62. The shaft 62 is appropriately journaled for rotation and it extends through the side panels 24 and 26 of the cabinet 22. The shaft 62 is secured by pins to the side beams 52 and 54 of the walking beam assembly 50.

A curved head or cable track 58 is appropriately secured to the front beam 56. A cable 64 is in turn secured to the cable track 58. The curvature of the head or cable track 58 is of the same radius as that of the walking beam assembly 50 so that the cable 64 maintains a generally vertical orientation with respect to a sucker rod 66 for a pump (not shown) to which the cable 64 and the rod 66 are secured.

Since the curvature of the head 58 has the same radius as the walking beam assembly 50, the cable 64 remains aligned with the rod 66. The cable 64 and the head 58 are thus at all times tangent to the vertical axis of the rod 66. Thus, a pivoting or rocking movement of the walking beam assembly 50, carrying with it the cable track 58 and the cable 64, provides for the reciprocation of the sucker rod 66 secured to the cable 64. The cable 64 maintains its vertical alignment with the rod 66 due to the curvature of the track 58 as the walking beam assembly 50 pivots. The radius of the curvature of the head or track 58 is equal to the distance from the center of the shaft 62 outwardly to the head or track 58, which is the effective pivot radius of the walking beam assembly 50. This may best be understood from both FIGS. 1 and 2.

FIG. 2 is a view in partial section taken generally through the cabinet 22, showing the walking beam assembly 50 secured to the various elements disposed within the cabinet 22. The relationship between the elements within the cabinet 22 is shown with respect to the walking beam assembly 50.

A counterweight assembly 70 is secured to the walking beam assembly 50. The counterweight assembly 70 includes a rod 72 which extends outwardly substantially parallel to the side arms 52 and 54 of the walking beam assembly 50, and substantially perpendicular to the rear beam 60. The rod 72 is appropriately secured to the beam 60. A weight 74 is appropriately disposed on the rod 72. The weight 74 is movable on the rod 72 by means of a motor 76 and a threaded shaft 78, as will be discussed in detail below.

Within the cabinet 22 is a link 90. The link 90 is appropriately rigidly secured, as by a pin arrangement or by welding, etc, and the shaft 62 then imparts a pivoting movement to the walking beam assembly 50.

Three motors, including a motor 100 and a motor 76 shown in FIG. 1, and a motor 130 shown in FIG. 2, receive electrical energy from the photovoltaic array 10 through a controller 180. The controller 180 is only schematically illustrated. The motor 100 is connected to a flywheel 102 and to a pulley 104. The pulley 104 is connected by a belt 106 to a flywheel/pulley 108. The belt 106 is preferably a toothed belt, and the peripheries of the pulley 104 and the flywheel/pulley 108 are appropriately configured to mate with the teeth on the belt 106.

The flywheel/pulley 108 is fastened to a shaft 110. The shaft 110 is appropriately journaled on the side walls 24 and 26 of the cabinet 22.

Within the cabinet 22, the shaft 110 carries a pinion gear 112. The gear 112 is appropriately secured to the shaft 110 for rotation therewith. The pinion 112 meshes with the teeth on the outer perimeter or periphery of a bull gear 120. The bull gear 120 is secured to a shaft 124. The shaft 124, a hollow shaft, is appropriately journaled for rotation on the side 24 of the cabinet 22.

Connected to the side panel 24 of the cabinet 22 is the motor 130. The motor 130 includes an output shaft 132 which is disposed within the hollow shaft 124. On the distal end of the shaft 132, remote from the motor 130, is a beveled gear 134. The beveled gear 134 meshes with a mating beveled gear 146 of a shaft 140. The shaft 140 is disposed within a diametrically extending slot 122 in the bull gear 120. The slot 122 extends diametrically for less than the entire width of the bull gear 120. The shaft 140 is appropriately journaled for rotation within the slot 120.

The shaft 140 includes two threaded portions, a threaded portion 142 and a threaded portion 144. The threaded portions are separated slightly, and the beveled gear 146 is disposed on the inner section of the threaded portion 144. The purpose of the separation, or spacing apart, of the threaded portions 142 and 144 of the shaft 140 is, of course, to provide clearance for the beveled gear 146 and to allow for the meshing of the beveled gear 146 with the beveled gear 134 of the motor shaft 132.

FIG. 3 is an enlarged view of partial section of the bull gear 120, showing details of the threaded shaft 140 and the various elements associated therewith. The link 90 is also shown in FIG. 3.

FIG. 4 is a view in partial section through the link 90 and the bull gear 120, taken generally along line 4—4 of FIG. 3. The threaded shaft 140 is shown within the slot 122 in the bull gear 120.

Figure 5:
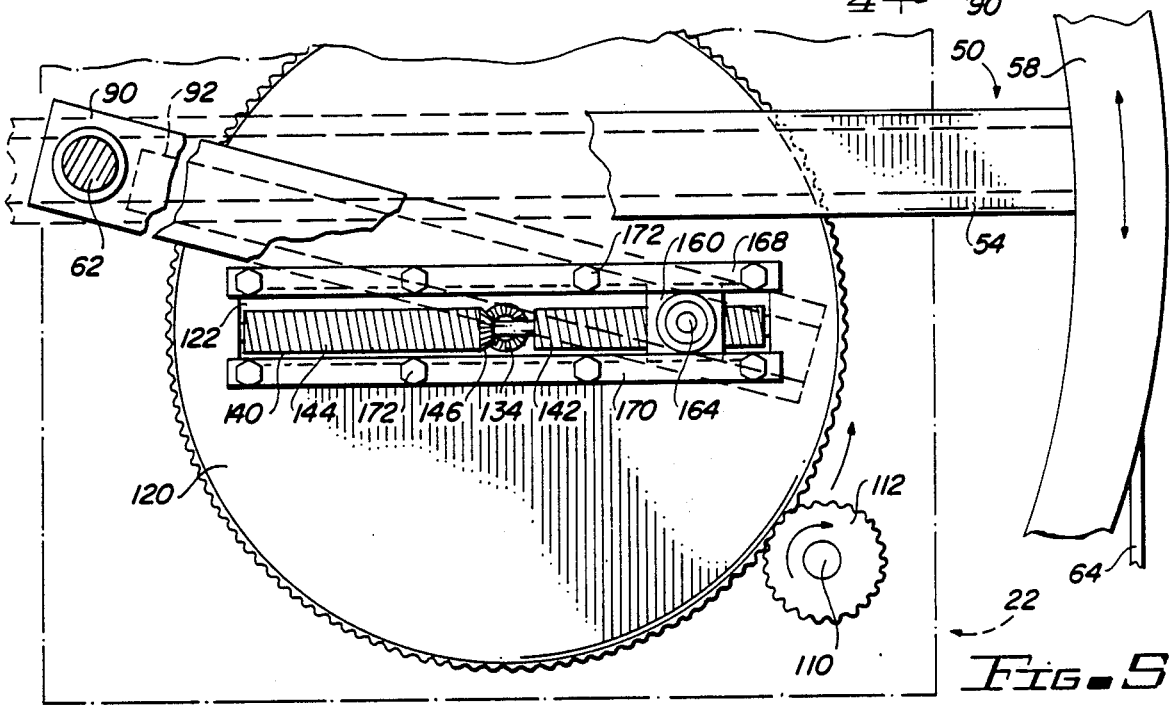
FIG. 5 is a side view of a portion of the apparatus of the present invention.

FIG. 5 is a side view in which the cabinet 22 is shown generally in phantom. FIG. 5 illustrates generally the operation and the cooperation among the various elements, including the walking beam assembly 50, the link 90, the bull gear 120, and the threaded shaft 140.

Figure 6:
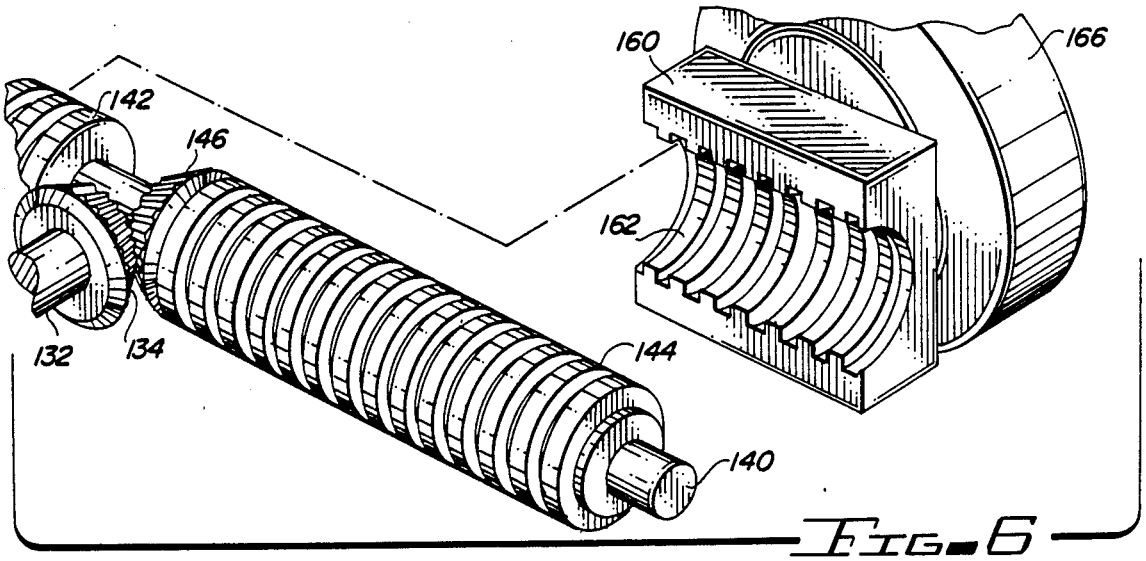
FIG. 6 is an exploded perspective view of a portion of the apparatus of the present invention.

FIG. 6 is an exploded perspective view showing a half nut 160 disposed away from, or separated from the rotating shaft 140. The motor shaft 132, with its beveled gear 134, is shown meshing with the beveled gear 146 of the shaft 140. For the following discussion, reference will be made primarily to FIGS. 2, 3, 4, 5, and 6.

The half nut 160 is appropriately secured to the threaded shaft 140 within the slot 122. The half nut 160 includes a threaded portion 162 which matingly engages the threaded portions 142 and 144 of the shaft 140. Secured to the half nut 160 is a shaft 164. The shaft 164 is in turn connected to a roller crank pin 166. The roller crank pin 166 is disposed within the slot 92 of the link 90.

The half nut 160 is disposed within the slot 122, or is confined therein, by a pair of plates 168 and 170. The plates 168 and 170 are appropriately secured to the bull gear by a plurality of screws 172. With the half nut 160 disposed within the slot 122, and held therein by the plates 168 and 170, the crank pin 166 is secured within the slot 92 of the link 90. The bull gear 120 and the link 90 are thus secured together for joint movement.

Rotation of the bull gear 120 causes a pivoting movement of the link 90. Since the link 90 is pinned to the shaft 62, as is the walking beam assembly 50, rotation of the bull gear 120 causes a pivoting movement of the walking beam assembly 50 through the link 90 and the shaft 62.

The roller crank pin 166 is appropriately journaled for rotation on the shaft 164. This is best shown in FIG. 4.

As is well known and understood, and as has been stated above, the output of the photovoltaic array 10 varies in response to the amount of sunlight impinging on the photovoltaic cells in the array. The electrical energy flowing to the motors 100, 130, and 76 accordingly varies. Obviously, several factors are involved. For example, on a typically clear day, a maximum amount of solar energy will be less in the early morning and in the late evening than in the middle of the day. Also, the sunlight falling on the array 10 will be less in the winter than in the summer. Finally, the weather, in terms of cloud cover, also is a factor which causes the electrical energy from the array 10 to vary.

An electrical controller 180 is schematically illustrated in FIGS. 1 and 2. The controller 180 is connected to the solar array 10 by the conduit 12, and in turn the controller 180 is coupled to the motor 100, the motor 130, and the motor 76 by appropriate conductors 182, 184, and 186, respectively. For convenience of illustration, only single lines are shown for the conductors 182, 184, and 166. However, the plural "conductors" will be used when referring individually to each of them.

The controller 180 is preferably appropriately secured to the cabinet 22. However, for convenience of illustration, the controller 180 is shown spaced apart from the cabinet 22.

The electrical energy output from the solar array or photovoltaic array 10 is transmitted to the controller 180. In turn, the electrical output is connected to the drive motor 100 by the conductors 182. The motor 100 is, of course, a direct current motor, and its energy output varies in accordance with the input current to it through the conductors 182. The current through the conductors 182 is directly correlated to the electrical energy output from the solar or photovoltaic array 10.

The motor 130 is also a direct current motor, but it is a reversible dc motor which controls the rotation of the shaft 132 and the pinion gear 134. In turn, the rotation of the shaft 132 and the pinion gear 134 causes rotation of the threaded shaft 140 within the slot 122 of the bull gear 120. Rotation of the shaft 140 causes the half nut 160 to move on the threaded portions 142 and 144. When the half nut 160 moves on the shaft 140, the crank pin 166 moves relative to the link 90 in the slot 92. The location of the crank pin 166 determines the length of stroke of the link 90, and accordingly the length of stroke of the walking beam assembly 50.

Figure 7C:
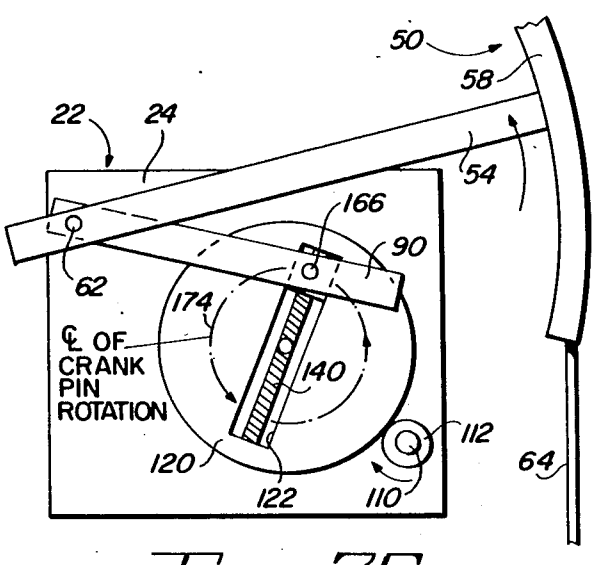
FIGS. 7A, 7B, and 7C are sequential views illustrating the operation of the apparatus of the present invention.
Figure 7B:
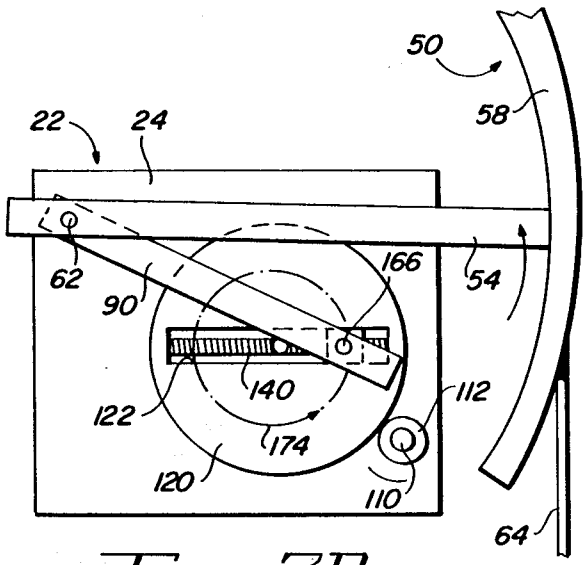
Figure 7A:
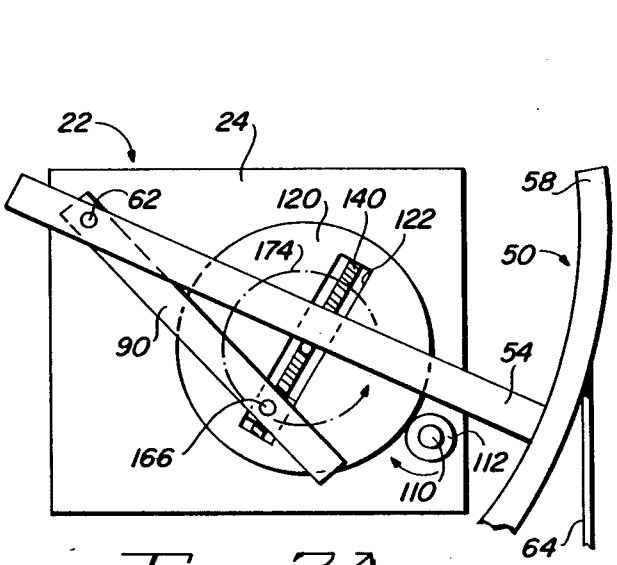
Figure 8C:
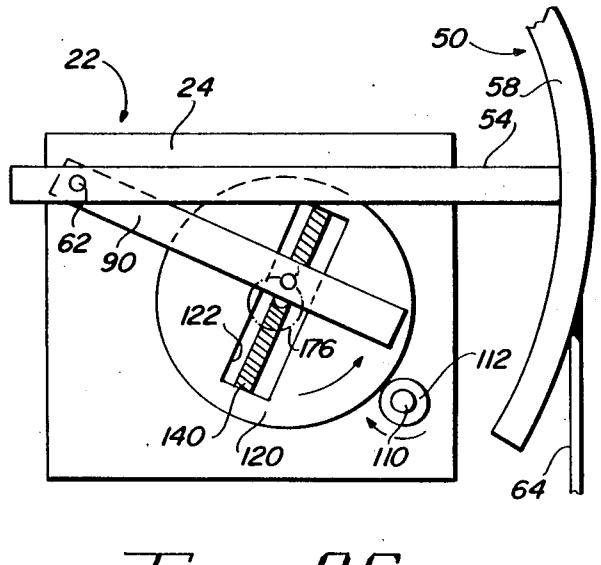
FIGS. 8A, 8B, and 8C are sequential views illustrating another facet of the operation of the apparatus of the present invention.
Figure 8B:
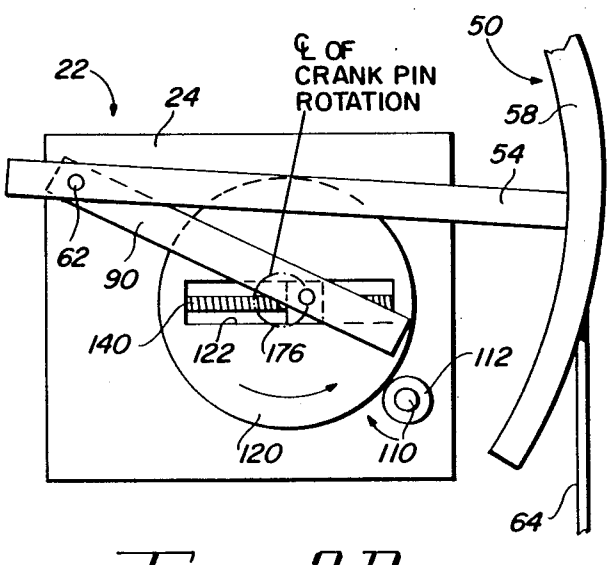
Figure 8A:
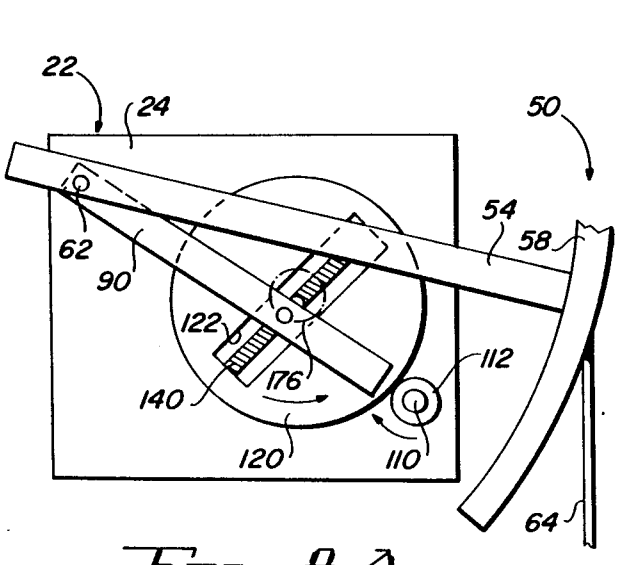

As best shown in FIG. 2, and as sequentially shown in FIGS. 7A, 7B, and 7C, and in FIGS. 8A, 8B, and 8C, the greater the distance the crank pin 166 is from the axis of rotation of the bull gear 120, which is through the central axes of the hollow shaft 124 and the shaft 122, the greater the stroke of the link 90 and of the walking beam assembly 50. The stroke of the link 90 and the walking beam assembly 50 therefore varies from a maximum when the nut 166 is disposed farthest from the center of rotation of the bull gear 120, to a minimum or zero movement when the nut 160 is disposed over the center of rotation of the bull gear.

Since rotation of the bull gear 120 carries the half nut 160, if the half nut 160 is disposed on the center of rotation of the bull gear 120, the crank pin 166 will simply rotate about its own axis on its shaft 164, and accordingly the link 90 will remain substantially motionless and therefore inoperative. The purpose of the motor 130 is to cause the shaft 140 to rotate, and thus to move the crank pin 166 to vary the stroke of the link 90 and of the walking beam assembly 50 in response to the electrical output from the solar array 10.

When the output of the solar array 10 is maximum, the half nut 160 will be disposed at a maximum distance away from the center of rotation of the bull gear 120. As the output of the solar array 10 decreases, the motor 130 will be actuated through the controller 180 to cause rotation of the shaft 140 to move the half nut 160, and accordingly the crank pin 166, inwardly toward the center of rotation of the bull gear 120, and thus to decrease the radius of rotation of the half nut 160 and of the crank pin 166. At such time as the output of the motor 130, and accordingly of the photovoltaic system 10, decreases to zero, the nut 160 will be disposed substantially on the center of rotation of the bull gear 120, which is on the longitudinal axes of the shafts 124 and 132.

FIG. 7A is a schematic representation of the pivoting movement of the walking beam assembly 50 in response to rotation of the bull gear 120. The crank pin 166 is shown in FIGS. 7A, 7B, and 7C at about a maximum radius from the center of rotation of the bull gear 120. As the bull gear 120 rotates, the shaft 140 within the slot 122 moves with it. The crank pin 166, disposed on the shaft 140, carried on the shaft 140, defines a circle shown in FIGS. 7A, 7B, and 7C as a dotted line circle with an arrowhead on it, and identified by reference numeral 174. The arrowhead indicates the direction of rotation of the bull gear 120.

In FIG. 7A, the walking beam assembly 50 is nearing or is about at the lowermost point in its travel, or the end of its downstroke, as the crank pin 166 approaches a tangent point to the circle 174 from the center of rotation of the shaft 62. In FIG. 7B, the crank pin 166 is shown about in the middle between its bottom-most and uppermost position. The walking beam assembly 50 is about at the midpoint of its travel between its bottom-most and uppermost positions. The slot 122 in the bull gear 120 is substantially horizontal.

In FIG. 7C, the walking beam assembly 50 is approaching or is about at its highest point, or the apex of its upstroke, as the crank pin 166 approaches another tangent point on the circle 174 from the center of rotation of the shaft 62. Continued rotation of the bull gear 120, in the direction shown by the arrowheads on the dotted line circles 174, will result in the downward movement of the walking beam assembly 50 as the crank pin 166 moves from the position shown in FIG. 6C to about the position shown in FIG. 7A. The downstroke movement of the walking beam assembly 50 is thus accomplished between about the positions shown in FIG. 7C and that shown in FIG. 7A.

It will be noted that the positions of the walking beam assembly shown in FIGS. 7A and 7C represent respectively the lowest and the highest or uppermost positions of the walking beam assembly. Straight lines from the center of rotation of shaft 62 and tangent to dotted line circle 174, which represents the rotation path of the center of the crank pin 166, define the highest and lowest points of the walking beam assembly 50. In FIG. 7A, the crank pin 166 appears to be just past the lowest point, and in FIG. 7C, the crank pin 166 is about at the highest point. It will be noted that the angular distance between the tangent points is not one-hundred-eighty degrees.

The geometry of the mechanical linkage between the crank pin 166, the link 90, the shaft 62, and the walking beam assembly 50 provides a different rate of travel for the walking beam assembly 50 between its uppermost and lowermost positions. The upstroke, between the lowest position of the walking beam assembly 50 and its highest position, is accomplished during a rotation of slightly more than one-hundred-eighty degrees of the bull gear 120 due to the geometry of the elements involved. This is, of course, primarily due to the relative placement of the axis of the pivot shaft 62 and the axis of rotation of the bull gear 120.

As can best be understood from FIG. 7C, the "upstroke" of the walking beam assembly 50 is completed just before the crank pin 166 is at the vertical orientation of the slot 122 in the bull gear 120. Similarly, as may be understood from FIG. 7A, the upstroke of the walking beam assembly 50 begins before the crank pin 166 reaches its bottom-most point of travel, or before the next vertical orientation of the slot 122 of the bull gear 120. Thus, the total upstroke or power stroke for the apparatus 10 and specifically for the walking beam assembly 50 and its cable 62, extends for a rotational distance of greater than one-hundred-eighty degrees for the bull gear 120.

Correspondingly, the downstroke of the walking beam assembly 50 takes place in a rotational distance of the bull gear 120 of slightly less than one-hundred-eighty degrees. With the bull gear 120 moving or rotating a constant velocity, it follows that the downstroke of the walking beam assembly 50 will take place in less time than the upstroke. Or, phrased another way, the power stroke, or the upstroke of the walking beam assembly 50, will take a relatively longer time than the downstroke. A favorable mechanical advantage is thus acquired.

Since the output of the photovoltaic array 10 varies in response to the sunlight, the current will increase or decrease in accordance with the time of the day, cloud cover, etc. The voltage output of the array 10, however, remains substantially constant. With the voltage remaining substantially constant, the motor 100 will run at a substantially constant speed, but its output will vary according to the current output of the array 10.

With the load from the pump being substantially constant, a decreasing current flow to the drive motor 100 will result in a slowing of the speed of the motor 100. The reduction in speed is sensed by the controller 180, and the motor 130 is actuated. The motor 130, which is a controller motor, rotates its shaft 130 and the beveled gear 134 secured to the distal end of the shaft 132. Rotation of the threaded shaft 140, by the mating of its beveled gear 146 with the gear 134, then occurs. As the shaft 140 is rotated to move the half nut 160 and its crank pin 166 toward the center of rotation of the bull gear 120, the length of the stroke of the walking beam assembly 50 is decreased in accordance with the decreasing radius of the lever arm of the link 90. The radius of rotation of the crank pin 166 decreased with the decreasing current output of the photovoltaic array 10 until it becomes zero when it is disposed over the axis of rotation of the bull gear 120. When the length of the crank arm, which is the radius of rotation of the crank pin 166, is zero, obviously the walking beam 50 will remain immobile, and thus the length of the pumping stroke will be zero.

In FIGS. 7A, 7B, and 7C, the length of the crank arm is approximately maximum, indicating a maximum current output from the photovoltaic array 10. In FIGS. 8A, 8B, and 8C, the length of the crank arm, or the distance between the crank pin 166 and the axis of rotation from the bull gear 120, is substantially decreased, and is approaching minimum. However, as indicated by a dotted line circle in FIGS. 8A, 8B, and 8C, and identified by reference numeral 176, the length of the crank arm, or the radius of rotation of the crank pin 166 is not zero, but is still a positive or finite distance. Accordingly, there will still be provided a stroke of a finite length for the walking beam assembly 50. The stroke will be minimum, but some pumping action will still result. Thus, the pumping ability of the apparatus 10 is matched to the current output of the photovoltaic array 10. The matching of the output of the photovoltaic array 10 to the pumping load of the walking beam assembly is accomplished by rotation of the controller motor 130 to cause the half nut 160 and the crank pin 166 to move inwardly from the position shown in FIGS. 7A, 7B, and 7C, to the position shown in FIGS. 8A, 8B, and 8C.

In practice, after the controller motor 130 has been actuated to rotate the threaded shaft 140, and thus to move the half nut 160 inwardly toward the axis of rotation of the bull gear 120 a predetermined amount, the controller motor 130 turns off, and a pause of a predetermined time period occurs to give the apparatus 20 an opportunity to stabilize. If the speed of the drive motor 100 does not increase to its predetermined set point rpm, the controller motor 130 is again actuated to cause the rotation of the threaded shaft 140 to again move the half nut 160 and its crank pin 166 toward the center of rotation of the bull gear 120. The sequence of pause and reactuation, if necessary, continues unitl the predetermined set point of the motor 100 is reached. At this time, a balance is achieved between the output of the photovoltaic array 10 and the load of the pumping apparatus connected to the cable 62.

FIGS. 8A, 8B, and 8C show sequentially the decreased length of stroke of the walking beam assembly 50 as the crank arm of the link 90 decreases from that shown in FIGS. 7A, 7B, and 7C. In FIG. 8A, the downstroke of the walking beam assembly 50 is at or approaching its bottom position, and the bottom portion is substantially above the bottom portion of the stroke of the walking beam apparatus illustrated in FIG. 7A, 7B, and 7C. The length of strokes between the two positions is substantially different.

FIG. 8B shows about the midpoint position of the stroke of the walking beam assembly 50 with the decreased lever arm. FIG. 8C shows the walking beam assembly 50 at about or approaching its uppermost or top point of its pumping stroke. Obviously, the top or upper point of the pumping stroke of the walking beam assembly as illustrated in FIG. 8C is not nearly as high as that illustrated in FIG. 7C, again illustrating the difference between the two lengths of pumping strokes of the apparatus 20 as determined by the lengths of the lever arms of the apparatus under two different conditions or circumstances. The conditions are in turn correlated with the current output of the photovoltaic array 10.

During the day, minor fluctuations in the sunlight, due for example, to transient clouds, will generally be handled by the use of the flywheels 102 and 108, and thus only minor utilization of the controller 180 will probably be necessary to adjust the position of the half nut 160, and accordingly the varying of the pivot arm of the line 90.

As is well known and understood, flywheels are preferably designed to work in conjunction with a motor at a predetermined speed. Accordingly, the motor 100 is designed for constant speed operation, but with a varying output. The motor 100, a dc motor, operates at substantially constant speed on the substantially constant voltage output from the photovoltaic array 10. The varying current output of the photovoltaic array 10 results in the varying amperage of the motor 100, and accordingly in the varying output of the apparatus 20. Utilizing the controller motor 130, the load from a pump may be varied in response to the current draw, and therefore in repsonse to the capacity of the motor 100 and the array 10.

In the evening, as radiant energy decreases, the output of the motor 100 decreases to substantially zero, and in response to the decreasing output of the motor, or the decreasing current output of the array 10, the length of the pivot arm of the link 90 decreases to substantially zero when the half nut 160, and the crank pin 166, is disposed over the center of rotation of the bull gear 120.

The next morning, as the solar energy increases, the output from the solar array 10 begins and the drive motor 100 is turned on. The length of the stroke of the walking beam assembly 100 is zero, and thus no load is imposed on the motor 100.

As the amount of sunlight increases, the current from the photovoltaic array 10 increases until the drive motor 100 reaches full speed, which is the upper set point of the motor 100 for the controller 180. When this happens, the controller 180 causes the controller motor 130 to lengthen the stoke of the walking beam assembly 110 by a predetermined amount. That is, the controller motor 130 is turned on, and its shaft 132 causes its gear 134 to rotate the shaft 140 through the gear 146, which meshes with the gear 134.

The half nut 160 is moved away from the center point, or the zero load and zero stroke point, until a minimum positive length of stroke of the walking beam assembly 50 is reached. There is then a slight time delay of the controller motor 130 in response to the controller 180 to allow the apparatus 20 to stabilize. When the apparatus 20 is stabilized, meaning that the speed of the motor 100 stabilizes, the speed of the motor 100 is read again by the controller 180. If the speed of the motor 100 is still above the upper set point, the controller 180 again lengthens the stroke of the walking beam assembly 50 by driving the controller motor 130 to again move the half nut 160 and its crank pin 166 farther away from the center of rotation. Thus, the length of the pivot arm of the link 90 is increased in response to the output of the array 10. When the predetermined set point speed of the motor 100 is reached, the load on the apparatus 20 balances the electrical power output of the array 10.

During the day, as the solar energy increases to maximum output from the array 10, the load on the apparatus 20 also increases to maximum. The length of stroke of the walking beam system 50 increases to maximum as the lever arm for the link 90 increases to maximum. This is accomplished, of course, when the half nut 160 is in its farthest away position from the axis of rotation of the bull gear 120.

Conversely, as the solar radiation decreases, the load on the apparatus 20 is out of balance with the current output of the array 10, and such imbalance is sensed by the controller 180 in response to a decrease in the speed or rpm of the drive motor 100. In response to the decrease in rpm below the predetermined set point, the controller 180 actuates the controller motor 130 to cause rotation of the shaft 140 to move the half nut 160 inwardly toward the center of rotation of the bull gear 120. This results in the decreasing lever arm for the line 90, and a concomitant decrease in the length of stroke of the walking beam assembly 50.

The lengthening or decreasing of the lever arm of the link 90 continues under the direction of the controller 180 and the controller motor 130 to match the load of the apparatus 20 to the output of the photovoltaic array 10. Thus, while the speed of the drive motor 100 and the speed of the bull gear 120 is substantially constant, the output of the apparatus 20 varies in response to the current output of the photovoltaic array 10.

The variable stroke capability of the apparatus 20 provides a substantial mechanical advantage when the stroke is minimum, and accordingly the apparatus has sufficient power to unstick pump cylinders and to overcome other such problems as sand, paraffin, etc.

Referring again to FIG. 2, it will be understood that the controller motor 130 rotates with the bull gear 120 and with its hollow shaft 124. Accordingly, appropriate slip rings, brushes, etc. are required to electrically connect the motor 130 and the controller 180.

On the other hand, the motor 100 does not rotate, but rather it is fixed in place, and thus conventional wire connections may be made between the controller 180 and the motor 100.

Referring again to FIG. 1, there is shown a motor 76 secured to the rear beam 60 of the walking beam assembly 50. Extending outwardly from the motor 76 is a threaded shaft 78. The threaded shaft 78 extends to and through an internally threaded aperture in the weight 74. Appropriate electrical connectors 186 extend between the controller 180 and the motor 76. The motor 76 is a reversible dc motor, and thus rotation of the threaded shaft 78 causes the weight 74 to move axially along the rod 72. Movement of the weight 74 along the rod 72 balances the load of the liquid being pumped by the apparatus 20.

The load of the pump to which the pump rod 66 is connected, and thus the load of the liquid being pumped by the walking beam assembly 50, is manifest by a difference in the current draw of the apparatus 20 through the drive motor 100. By sensing the current draw on the downstroke of the walking beam assembly 50 and the current draw on the upstroke of the walking beam assembly 50, the controller 180 actuates the motor 76 to move the weight inwardly or outwardly on the rod 72 to balance the load. When the current draw is within predetermined parameters, the weight 74 substantially balances the load of the liquid being pumped.

The controller 180 senses fluctuations in speed of the drive motor 100 to control the placement of the crank pin 166 to adjust the lever arm of the link 90. In this manner, the drive motor 100 operates at substantially constant speed, although its current varies with the output of the photovoltaic array 10. At the same time, the controller 180 senses the current draw of the drive motor 100 on both the downstroke and the upstroke, which is the pumping or work stroke, of the walking beam assembly 50. In response to predetermined differences in the current draw, the motor 76 is actuated to move the weight 74 axially along the rod 72 to maintain the proper balance on the walking beam assembly 50.

When the controller 180 senses power being lost by a decrease in the rpm of the drive motor 100, the controller or gear motor 130 is actuated to move the half nut 160 and its crank pin 166 closer to the center of rotation of the bull gear. Conversely, as power increases, an increase in the rpm of the motor 100 is sensed by the controller 180. The motor 130 is actuated to move the half nut 160 and its crank pin 166 farther away form the center of rotation of the bull gear.

As power decreases, for example, as evening approaches, the length of the stroke gradually decreases. When the power output of the pv array 10 gets below a predetermined set point, available power goes to the controller or gear motor 130 to move the crank pin 166 to the center of rotation of the bull gear 130.

With the center of rotation of the bull gear coinciding with the axis of rotation of the crank pin 166, the length of the crank arm for the link 90 is zero, and accordingly no pivoting of the link 90 takes place and correspondingly there is no pivoting of the shaft 62 or of the walking beam assembly 50, and no pumping takes place.

With the crank pin 166 centered when there is no power output from the photovoltaic (pv) array 10, the apparatus 20 stops without a load and starts without a load.

If power cuts out suddenly, as when a cloud suddenly covers the sun, and there is not sufficient power from the photovoltaic array 10 to move the crank pin 166 to the center of rotation of the bull gear 120 to decrease the load to zero, then battery power is used to move the crank pin 166. This will be discussed in detail below.

Assuming that the apparatus 20 is powered down with the pin 166 at the center of rotation of the bull gear 120, when the solar array 10 begins anew to provide an output, the motor 100 is first powered up to bring its rpm up to its normal running speed. When additional power output is provided by the array 10, only then does the motor 130 begin to move the pin 166 away from the center of rotation of the bull gear 120 to begin pumping operations with a minimum stroke. However, although the length of stroke of the walking beam assembly is minimum, it is obvious that its mechanical advantage is tremendous, and that it can accordingly overcome any minor problems such as sand, paraffin, a stuck piston, etc.

Upon the sensing of increasing current output from the array 10, the controller 180 actuates the controller motor 130 to rotate the threaded shaft 140. As the threaded shaft 140 rotates, the half nut 160 moves farther away from the center of rotation of the bull gear 120, and the crank pin 166 moves outwardly in the slot 92 of the link 90 to provide an increase in the length of the lever arm for the link 90. The link 90, the shaft 62, and the walking beam 58 accordingly lengthen their movements, causing the head 58 and the cable 64 to lengthen the pumping strokes of the rod 66, all in response to the increasing output of the photovoltaic array 10.

FIG. 9 is a circuit diagram showing the inter-relationship between the photovoltaic array 10, the control circuitry block 180, and the motors 76, 100, and 130.

The photovoltaic array 10 is divided into two portions, with a pair of conductors extending from each portion to the control block 180. The control block 180, which comprises the various circuit components and related elements for controlling the motors, includes several separate elements shown as blocks in FIG. 9. They include an analog-to-digital converter 220, a microprocessor 230, and four relays. A rechargeable battery 274 is also shown in the control block 180.

As is obvious, appropriate sofware programming is utilized in the microprocessor 30 for controlling the various functions discussed above in conjunction with the operation of the pump apparatus 20. Details on the software will not be given, because such is well known and understood, and may be accomplished by virtually any computer programmer of ordinary skill in the art. Microprocessors are also common elements, well known and understood in the art, and further detailed discussion of the microprocessor 230 will similarly not be given.

In FIG. 1, a single electrical conduit 12 is illustrated, and a plurality of conductors are disposed within the electrical conduit from the photovoltaic array 10 to the controller 180. Specifically, there are four conductors illustrated in FIG. 9 as being disposed within the conduit 12, or as comprising the electrical conductors of conduit 12. They include a conductor 202 and a conductor 204. The conductor 202 extends from the photovoltaic array 10 to the controller 180 and directly to the motor 100. The conductor 202 is a negative conductor. Conductor 204, a positive conductor, extends from the photovoltaic array 10 to the analog-to-digital converter 220. From the conductor 204, a conductor 206 extends through a resistor 208 as a second input to the analog-to-digital converter 220. A conductor 210 extends from the conductor 206 between the resistor 208 and the A-D converter 220 and the motor 100. From the analog-to-digital converter 220 a conductor 222 extends to the microprocessor 230.

The current draw of the pump motor 100 is monitored by the microprocessor 230 for adjusting the counterweight 74 on the rod 72. The current draw is determined in accordance with the voltage drop across the resistor 208. The resistor 208 is in series between the photovoltaic array 10 and the pump motor 100. The voltage drop across the resistor 208, which is proportional to the current draw of the motor 100, is changed from analog signal to a digital signal by the analog-to-digital converter 220. The digital signal is in turn transmitted to the microprocessor 230 on the conductor 222.

The digital signal transmitted to the microprocessor 230 from the analog-to-digital converter 220 is stored by the microprocessor. The current draw of the motor 100, or the voltage drop across the resistor 208, is sampled periodically by the processor 230 and the values are stored.

If a change in the position of the weight 74 is required for the counterweight assembly 70 by the motor 76, an appropriate control signal is transmitted from the microprocessor to either of a pair of relays associated with the motor 76.

A control signal from the microprocessor 230 is transmitted on conductor 232 to a relay 234. A conductor 240 also transmits a control signal from the microprocessor 230 to a second relay 242. The relay 234 and 242 control the current flow to the motor 76. The motor 76 in turn controls rotation of the screw 78 to move the weight 74 inwardly and outwardly on the rod 72 of the counterweight assembly 70.

The relay 234 comprises the forward relay from the counterbalance gear motor 76. From the relay 234, a pair of conductors 236 and 238 extend to the motor 76. This will be discussed in detail below.

The control conductor 240 extends from the microprocessor 230 to the relay 242, which is a reverse relay for the motor 76. From the relay 242, a pair of conductors 244 and 246 extend ultimately to the motor 76. In actuality, and as illustrated in FIG. 9, the conductor 236 extends from the relay 234 directly to one side of the motor 76. The conductor 238 from the relay 234 extends to the conductor 244. The conductor 244 extends directly from the relay 242 to the other side of the motor 76, or opposite side of the motor 76 from the conductor 236. The conductor 246 extends from the relay 242 to the conductor 236. Illustrated in FIG. 1, a conductor 186 extends from the controller 180 to the motor 76. The conductor 186 comprises a pair of conductors, specifically identified in FIG. 9 as conductors 230 and 244.

For the pivot gear motor 130, a pair of control conductors 250 and 260 extend from the microprocessor 230 to a pair of relays 252 and 262, respectively. The relay 252 is a forward direction relay for the motor 130, and the relay 262 is a reverse direction relay for the motor 130. The control signal on conductor 250 extends from the microprocessor to the relay 252. From the relay 252, a pair of conductors 254 and 256 extend ultimately to the motor 130. The conductor 254 extends directly to one side of the motor 130.

The control conductor 260 extends to the reverse relay 262. From the relay 262, a pair of conductors 264 and 266 extend ultimately to the motor 130. The conductor 262 extends directly from the relay 262 to the opposite side of the motor 130 from the conductor 254. The conductors 254 and 264 comprise the conductor 184 shown in FIG. 1.

The conductor 256 from the relay 252 extends to the conductor 264, and the conductor 266 from the relay 262 extends to the conductor 254. Thus, current from the relay 252 flows to both sides of the motor 130, and current through the relay 262 also flows to both sides of the motor 130 for operating the motor 130 in the desired direction. Similarly, current flows from the relay 234 to both sides of the motor 76, and current from the relay 242 flows to both sides of the motor 76. The motors 76 and 130 are reversible motors, as discussed above, and the forward relays 234 and 252 are actuated to cause the motors 76 and 130 to operate in their forward direction. Current flow through the relays 242 and 262, when the relays are respectively actuated, causes the motors 76 and 130 to be operated in their reverse directions.

A second pair of conductors 270 and 272 extend from the photovoltaic array 10 to the microprocessor 230. A rechargeable battery 274 is connected in parallel across the conductors 270 and 272. The battery 274 provides current for the microprocessor 230 when the output from the photovoltaic array 10 is too low to provide sufficient current for operating the microprocessor, and the battery 274 also provides sufficient power to operate the motors 76 and 130, and their relays, when the output from the photovoltaic array 10 is too low to provide sufficient current.

A conductor 280 extends from the conductor 272 to the relay 262. From the conductor 280, a conductor 282 extends to the relay 234, a conductor 284 extends to the relay 242, and a conductor 286 extends to the relay 252. From the conductor 270, a conductor 290 also extends to the relay 262. A conductor 292 extends from the conductor 290 to the relay 234, a conductor 294 extends from the conductor 290 to the relay 242, and a conductor 296 extends from the conductor 290 to the relay 252. Thus, all four of the relays 234, 242, 252, and 262 are provided with electrical power from the photovoltaic array 10 and from the battery 274.

A tachometer or rpm sensor 300 is shown in FIG. 9 connected to the pump motor 100. A tachometer or rpm sensor 300 is connected to the microprocessor 230 by a conductor 302.

The rpm sensor 300 is preferably disposed within the endbell housing of the motor 100. It may be an optointerrupter or a phototransistor which provides an output pulse each rpm. The output pulses from the sensor 300 are transmitted on conductor 302 to the microprocessor 230. The speed of the motor 10 varies with the voltage output of the photovoltaic array 10 on the conductors 202 and 204 and also with the load on the motor, which is the pumping action of the walking beam of the assembly and its pumping load. The controller 180, through the microprocessor 230, adjusts the length of the stroke of the walking beam assembly 50 by control of the pivot gear motor 130. The adjustment of the length of the stroke is made in response to the information provided from the rpm sensor 300.

The counterbalance gear motor 76 is also controlled by the microprocessor 230. The source of information for the control of the counterbalance gear motor 76 is in the analog-to-digial converter 220. The primary function of the analog-to-digital converter 220 is to sense the current drop across the resistor 208 in response to the load on the pump motor 100.

For operation of the motor 76, additional information is needed by the microprocessor 230. The additional information comprises the knowing of the position of the walking beam assembly 50, whether the walking beam assembly 50 is on an upstroke or on a downstroke. This is sensed by a position sensor 310. The position sensor 310 may be a mercury switch located on the walking beam assembly 50, a phototransistor system in conjunction with the walking beam assembly, or any other appropriate device.

The position sensor 310 is secured to the walking beam assembly. The position sensor 310 is used to determine whether the output signals from the analog-to-digital converter 200 to the microprocessor 220 are from an upstroke or from a downstroke. The position sensor transmits its output signal to the microprocessor 230 on conductor 312.

The microprocessor 230 monitors the amperage or current draw of the pump motor 100 by reading the voltage drop across the resistor 208. The voltage drop across the resistor 208 is changed from an analog signal to a digital signal by the analog-to-digital converter 220. The output signal from the analog-to-digital converter 220 is transmitted to the microprocessor on conductors 222 and 224. The analog signal is stored by the microprocessor.

The microprocessor then seeks position information from the position sensor 310. The output signal from the position sensor 310 is transmitted to the microprocessor on conductor 312.

If the walking beam assembly 50 were on an upstroke, the microprocessor waits for another signal from the analog-to-digital converter in response to the next stroke of the walking beam assembly 50. The next signal is, of course, responsive to the current draw of the motor 100 on a downstroke. The microprocessor then compares the two signals, which are digital outputs from the analog-to-digital converter 220, to determine which signal is the highest. The difference in amplitude between the two signals is then used to determine if an adjustment is needed to be made in the position of the counterbalance weight 74. If an adjustment is needed, a determination is made in which direction and to what extent.

If an adjustment is to be made in the length of the lever arm of the counterweight assembly 70, than either the relay 234 or the relay 242 is actuated to cause the motor 76 to rotate in the proper direction and for a distance proportional to the offset error determined from the output signals of the converter 220.

When an adjustment is to be made in the position of the counterweight 74 on the rod 72, the microprocessor 230 transmits an appropriate control signal on either the control conductor 232 or the control conductor 240 to either the forward direction relay 234 or the reverse direction relay 242, respectively, to cause the motor 76 to rotate the shaft 78 to move the counterweight 74 relative to the rod 72. The correction continues until the current draw on the upstroke and the downstroke is substantially the same. That is, the offset error is essentially zero. At such time, the counterweight 74 is in the proper position relative to the shaft 72 and to the walking beam assembly 50.

It will be noted that there are no control switches associated with the pump motor 100. As has been discussed above, the pump motor 100 will operate any time there is sufficient voltage provided by the photovoltaic array 100. However, the motor 100 may operate without causing any pumping action or pivoting movement of the walking beam assembly 150. This will occur, of course, when the half nut 160 is positioned in the center of the axis of rotation of the bull gear 120 and the motor 130.

When the output from the photovoltaic array 10 is sufficient to cause the motor 100 to start, the rpm sensor 300 provides output pulses to the microprocessor 230 on conductor 302. The microprocessor interprets the output pulses in terms of motor rpm. The microprocessor 230 then compares a predetermined low point rpm value to the rpm sensed and the two values are compared. If the rpm of the motor 100 is below the minimum set point, and if the stroke is already at zero, as for example when the photovoltaic array 10 initially provides an output in response to the sun, then no control signal is transmitted by the microprocessor 230 to the relays 252 or 262. However, when the increasing output of the array 10 causes the speed of the motor 100 to increase above the minimum set point, then the microprocessor 230 transmits a signal on the control conductor 250 to the forward relay 252. Current then flows through conductors 286 and 296 to the motor 130 to cause the motor 130 to rotate the threaded shaft 144 to move the threaded nut 160 away from the center of rotation of the bull gear 120. Thus, a beginning stroke is made by the walking beam assembly 50.

If the speed of the motor 100 remains above the lower set point and continues to increase, and increases above a second predetermined set point, an upper set point, then the forward relay 252 is again actuated by a control signal on conductor 250 to actuate the motor 130 to again move the half nut 160 another predetermined distance away from the axis of rotation of the bull gear 120. This continues until the rpm of the motor 100 is controlled between the two predetermined set points, the lower set point and the upper set point.

If the output of the array 10 drops, the rpm of the motor 100 also drops. When the rpm of the motor 100 drops below the lower set point, then the microprocessor transmits a control signal on the control conductor 260 to the reverse relay 262. The motor 130 is actuated in its reverse direction by the relay 262 to cause the threaded shaft 144 to rotate to move the half nut 160 closer to the axis of rotation of the bull gear 120. This reduces the length of the stroke of the walking beam assembly 50. If the output of the array 10 continues to decrease, thus decreasing the rpm of the motor 100, the relay 262 continues to be actuated by a control signal from the microprocessor 230 on the conductor 260 to continue to decrease the length of the stroke until the speed of the motor 100 stabilizes within the two predetermined set points.

Assuming the end of a day, or the passing of a sizeable cloud bank between the sun and the array 10, the decreasing voltage output from the array 10 will cause the rpm of the motor 100 to be reduced in value. Along with the decreasing rpm of the motor 100 is the reduced length of stroke of the walking beam assembly 50 as the half nut 160 is moved closer and closer to the center of rotation of the bull gear 120, until the half nut 160 is positioned over the center of rotation of the half nut 160, at which time the length of the pumping stroke of the walking beam assembly 50 is zero.

As discussed in detail above, to decrease the stroke of the walking beam assembly, the motor 130 is actuated to move the half nut 160 closer to the axis of rotation of the motor 130, or closer to the shaft 132 of the motor 130. This is accomplished by rotating the threaded shaft 140 in the proper direction.

On the other hand, if the length of the stroke of the walking beam assembly is to be increased, then the motor 130 is actuated to rotate the threaded shaft 144 to move the half nut 160 away from the center of rotation of the motor 130. As discussed above, the axis of rotation of the bull gear 120 is the same as the axis of rotation of the motor 130 and its shaft 132, and thus, the half nut 160 is moved relative to both the axis of rotation of the motor 130 and of the bull gear 120 in order to change the length of stroke of the walking beam assembly 50.

The forward relay 252 is energized by an appropriate control signal on the conductor 250 to cause the motor 130 to rotate to lengthen the stroke of the walking beam assembly 50 by moving the half nut 160 away from the center of rotation of the bull gear 120 and the motor 130. To decrease the length of the stroke, the reverse direction relay or solenoid 262 is actuated by an appropriate signal on the control conductor 260 to reverse the direction of the motor 130 to cause the half nut 160 to be moved closer to the center of rotation of the bull gear 120 and the motor 130.

As described above, the microprocessor 230, under appropriate programming, controls the length of the stroke of the walking beam assembly 50 in response to the speed of the motor 100. At the same time, the microprocessor 230 controls the position of the counterweight 74 to equalize the current draw of the motor 100 on the upstroke and the downstroke of the walking beam assembly 50.

In the embodiment of FIGS. 1–9, the speed of the drive motor 100 remains substantially constant, and the length of the pumping stroke varies. In addition to the variable length of the pumping stroke, the speed of the upstroke and the downstroke varies. The downstroke is faster than the upstroke due to the geometry of the mechanical linkage. In the embodiment of FIGS. 10, 11, and 12, the length of the pumping stroke remains substantially constant, but the speed of the pumping motor varies. However, the same feature of the variable speed of the upstroke and downstroke remains. The downstroke remains faster than the upstroke.

FIG. 10 comprises a schematic top view of pumping apparatus 400, which comprises an alternate embodiment of the apparatus of the present invention. The apparatus 400 includes a cabinet or housing 402, and a bull gear 410 is appropriately journaled for rotation on the cabinet or housing 402. The bull gear 410 includes an axle or shaft 412 which is appropriately journaled to the cabinet or housing.

A motor 420, which comprises a drive motor for the bull gear 410, is schematically illustrated as secured to the housing 402. A shaft 422 extends from the motor 420 to a pinion gear 424. The shaft 422 extends through one wall of the cabinet or housing 402, and is appropriately journaled for rotation therein. The motor 420 drives the bull gear 410 through the shaft 422 and the pinion gear 424.

A plate 430 is secured, as by screws, to the bull gear 420. The plate 420 is a carrier plate for a crank pin roller 432.

Disposed within the cabinet or housing 402 is a link 440 which is appropriately fixedly secured to a shaft 444. The shaft 444 is appropriately journaled for rotation on the housing 402 and, outside of the housing 402, the shaft 444 is secured to a walking beam 450. The rigid connection between the link 440 and the shaft 444, and the rigid connection between the shaft 444 and the walking beam 450, insures that the walking beam 450 moves in response to movement of the link 440. The link 440 includes a slot 442 in which the crank pin roller 432 extends. Movement of the crank pin roller, in response to rotation of the bull gear 410, causes the link 440 to pivot relative to the housing 402. The pivoting movement of the link 440 is in turn translated into the pivoting movement of the shaft 444 and the walking beam 450.

The walking beam 450 includes a pair of side elements 452 and 454. The side elements or members 452 and 454 are substantially parallel to each other. Extending between the outer ends of the side elements 452 and 454 are a pair of frame elements 456 and 458. The element 456, the front element, in turn includes a head 460 secured thereto. The rear element 458 includes a counterweight assembly secured to it. In the geometry of the walking beam 450, the distance from the shaft 444 to the front end member 456 is twice the distance between the shaft 444 and the rear member 458.

FIG. 11 is a representation of the bull gear 410 illustrating the plate 430 and its crank pin roller 432 in two different locations. The location at which the plate 430 is secured to the bull gear 410 determines the length of stroke of the link 440 and accordingly, through the shaft 444, of the walking beam 450. It will be noted that the plate 430 is secured away from the center of rotation, which is through the shaft 412, of the bull gear 410. If the plate 430 is rotated, as to the position shown in phantom in FIG. 11, the distance between the shaft 412 and the crank pin roller 432 changes. The change of the location will affect the length of stroke, ultimately, of the walking beam 450. In FIG. 11, there are two positions shown for securing the plate 430, and accordingly the crank pin roller 432, on the bull gear 410. Obviously, there could be other locations, also, so that the length of stroke may be varied, as desired.

In addition to the changing the location of the plate 430, and thus changing the location of the crank pin roller 432 relative to the center of rotation of the bull gear 410 about the shaft 412, there is a second way of changing the length of stroke of the walking beam 450. The second way is simply to reverse the walking beam 450 with respect to the head 460 and the counterweight assembly 470. Thus, if the head 460 were removed from the end frame member 456, and the counterweight assembly 470 were removed from the rear end frame member 458, and reversed, a different geometry for the walking beam 450 would result. Since the distance or ratio between the shaft 444 and the end plates 456 and 458 is two to one, placing the head 460 on the rear end frame 458, and placing the counterweight assembly 470 on the front frame member 456, will result in a two-to-one reduction in the length of the stroke of the walking beam assembly 450. Accordingly, whatever length of stroke is determined by the placement of the plate 430 and the crank pin roller 432, a further reduction, or a decrease by one-half of that stroke, may be obtained by reversing the placement of the head and the counterweight assembly on the walking beam 450.

FIG. 12 is a schematic diagram of the electrical system involved with the alternate embodiment 400. A photovoltaic (pv) array 480 is shown in a schematic illustration. The pv array 480 is connected to a controller 490 through a pair of conductors 482. The controller 490 is in turn connected to the motor 420 by a pair of conductors 492.

The controller 490 is a dc-dc converter which changes the current output of the pv array 480 to match the load on the motor 420. The controller 490 is a shelf item, such as a PCC-60 or PCC-90 controller manufactured by Balance of System Specialists, Scottsdale, Ariz. Essentially, the controller 490 downconverts voltage to increase current in accordance with the demand on the motor 420. The stroke remains constant, but the speed of the stroke changes. Thus, in the embodiment of apparatus 400, the length of the stroke of the walking beam assembly 450 is first determined and the plate 430, with its crank pin roller 432, is placed on the bull gear 410 at the particular location which will provide the desired length of stroke. If necessary, the walking beam assembly 450 is changed from that shown in FIG. 10 to decrease the stroke determined by the placement of the plate 430 in the crank pin roller 432.

Once the stroke is determined, it may be manually changed by changing the location of the plate 430 relative to the bull gear 410 or by changing the arrangement of the head 460 and counterweight 470 relative to the walking beam 450. However, while the apparatus 400 is in its fixed position, and is working, the length of the stroke remains constant, but the speed of the motor 420 changes in response to the electrical output of the pv array 480. The change is accomplished through the controller 490 by downconverting the voltage output of the pv array to increase the current as the output of the pv array decreases. Then, as the power output of the pv array increases, the controller 490 appropriately increases the voltage provided to the motor 420. Essentially, the controller 490 tries to maintain a constant output current regardless of the voltage.

As stated above, in both the embodiment of FIGS. 1–9 and the embodiment of FIGS. 10–12, the difference in the speed of the upstroke and the downstroke of the walking beam assemblies remains. The upstroke is slower than the downstroke due to the geometry of the mechanical linkage involved between the bull gear and the walking beam assembly.

In both embodiments, controllers are used to control the pumping capacities of the apparatus. In one embodiment, the speed of the drive motor for the pull gear maintains substantially constant speed (rpm) and the length of the pump stroke varies. In the second embodiment, the length of the pumping stroke remains substantially constant and the speed of the drive motor which drives the pull gear varies. It will be noted that the length of the pumping stroke may be varied, but the change in the length of the pumping stroke must be manually accomplished by either one or two methods, by changing the location of the crank pin on the bull gear or by changing the geometry of the walking beam with respect to the pumping head. In both embodiments, the pumping capacity of the pump apparatus varies in accordance with the output of the pv array to which the apparatus is connected.

It will be noted that in the embodiment of FIGS. 1–9, a pulley and belt arrangement has been used by the drive motor and the pinion gear which turns the bull gear. In the embodiment of FIGS. 10–12, the drive motor is shown connected directly to a pinion gear through a drive shaft. This is a schematic representation only, since the belt arrangement of FIGS. 1–9 is preferred. However, if desired, a direct drive could also be used.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What I claim is:

1. Variable capacity pump apparatus having an upstroke and a downstroke, comprising, in combination:

input electrical means;

drive motor means powered by the input electrical means;

bull gear means rotationally driven by the drive motor means;

a pivoting shaft;

walking beam means rigidly secured to the pivoting shaft and pivotally movable therewith and adapted to be connected to a pump for providing pumping strokes for pumping a liquid;

link means rigidly connected to the pivoting shaft and movable to pivot the pivoting shaft;

crank pin means, including a crank pin, secured to the bull gear means and connected to the link means to pivot the link means in response to rotation of the bull gear means, and the location of the crank pin defines a pivot arm for the link means, the pivoting shaft, and the walking beam means; and electrical controller means for varying the pumping capacity of the walking beam means in response to the input electrical means.

2. The apparatus of claim 1 in which the crank pin is movably secured to the bull gear means, and the controller means moves the crank pin for providing a variable pivot arm for pivoting the link means, the pivoting shift, and the walking beam means to vary the pumping capacity.

3. The apparatus of claim 1 in which the controller means varies the speed of the drive motor means to vary the pumping capacity.

4. The appartus of claim 1 in which the crank pin means includes a plate and a crank pin, and the plate may be secured to the bull gear means at a plurality of locations to vary the pivot arm and the length of the pumping strokes.

5. The appartus of claim 1 in which the crank pin of the crank arm means is secured to the bull gear means, and the link means is secured to the pivoting shaft, so as to provide one speed for the upstroke and a different speed for the downstroke.

6. The apparatus of claim 1 in which the walking beam means includes a counterweight assembly and a pumping head.

7. The apparatus of claim 6 in which the locations of the counterweight and the pumping head are reversible to further defining the pivot arm.

8. Variable stroke pump apparatus, comprising, in combination:

output drive motor means;

bull gear means driven by the output drive motor means and having an axis of rotation;

a pivoting shaft;

walking beam means rigidly secured to the pivoting shaft and pivotally movable therewith and adapted to be connected to a pump for providing pumping strokes for pumping a liquid;

link means rigidly connected to the pivoting shaft and movable to pivot the pivoting shaft;

crank pin means movable relative to the axis of rotation of the bull gear means and movably connected to the link means to pivot the link means in response to rotation of the bull gear means and movable relative to the link means for providing a variable pivot arm for pivoting the link means, the pivoting shaft, and the walking beam means; and controller means for moving the crank pin means toward and away from the axis of rotation of the bull gear means to vary the length of the pivot arm of the link means and the length of stroke of the walking beam means.

9. The apparatus of claim 8 in which the link means includes a link and a first slot in the link, and the crank pin means includes a first portion disposed in the first slot for pivotally moving the link means.

10. The apparatus of claim 9 in which the bull gear means includes a bull gear journaled for rotation on the axis of rotation, and a diametrically extending second slot in the bull gear, and the crank pin means further includes a second portion disposed in the second slot in the bull gear and connected to the first portion for moving the first portion and the link in response to rotation of the bull gear and the location of the second portion relative to the axis of rotation of the bull gear.

11. The appartus of claim 10 in which the first portion of the crank pin means comprises a crank pin movably disposed in the first slot in the link.

12. The apparatus of claim 10 in which the second portion of the crank pin means includes a threaded shaft journaled for rotation in the second slot in the bull gear.

13. The apparatus of claim 12 in which the second portion of the crank pin means further includes a half nut movable on the threaded shaft in response to rotation of the threaded shaft, and the crank pin is secured to the half nut.

14. The apparatus of claim 8 in which the walking beam means includes frame means, a head connected to the frame means, and a cable secured to the head and adapted to be connected to a pump sucker rod for pumping the liquid load.

15. The apparatus of claim 14 in which the walking beam means further includes counterweight means secured to the frame means remote from the head for balancing the liquid load being pumped.

16. The apparatus of claim 15 in which the counterweight means includes a rod secured to the frame means and a weight movable on the rod.

17. The apparatus of claim 16 in which the counterweight means further includes counterweight motor means for moving the weight on the rod in response to changes in the pumping load.

18. The apparatus of claim 17 in which the controller means further includes means for sensing the pumping load and for controlling the movement of the weight on the rod to balance the pumping load.

19. The apparatus of claim 18 in which the output drive motor means includes a drive motor having a variable output, and the controller means controls the counterweight motor means in response to the output of the drive motor.

20. The apparatus of claim 8 in which the controller means includes means for sensing the output of the drive motor means, and controller motor means for moving the crank pin means relative to the axis of rotation of the bull gear means in response to the output of the drive motor means to vary the stroke of the walking beam means.

21. The apparatus of claim 20 in which the crank pin means includes a first portion movable diametrically towards and away from the axis of rotation of the bull gear means, and a crank pin movable with the first portion and connected to the link means for pivoting the link means in response to movement of the first portion and rotation of the bull gear means.

22. The apparatus of claim 21 in which the link means includes an axially extending slot, and the crank pin extends into the axially extending slot for pivoting the link means in response to rotation of the bull gear means.

23. The apparatus of claim 22 in which the bull gear means includes a bull gear coupled to the drive motor means and rotating in response to output of the drive motor means, and hollow shaft means secured to the bull gear and rotatable therewith.

24. The apparatus of claim 23 in which the controller motor means includes a controller motor actuable in response to the output of the drive motor means, and a shaft connected to the controller motor and extending through the hollow shaft means and coupled to the first portion of the crank pin means for moving the first portion towards and away from the axis of rotation of the bull gear to position the crank pin of the crank pin means in the axially extending slot in the link means.

25. The apparatus of claim 24 in which the controller motor is secured to the bull gear means and rotates therewith.

26. The apparatus of claim 25 in which the first portion of the crank pin includes a first threaded shaft portion, a second threaded shaft portion, a haft nut movable on the first and second threaded portions, and the crank pin is secured to the half nut and is movable therewith.

27. The apparatus of claim 26 in which the controller motor means further includes a first beveled gear secured to the shaft, and the threaded shaft means further includes a second beveled gear disposed between the first and second threaded portions for engaging the first beveled gear to rotate the threaded shaft means in response to rotation of the shaft of the controller motor means.

* * * * *